US007135092B2

(12) United States Patent
Minkkinen et al.

(10) Patent No.: US 7,135,092 B2
(45) Date of Patent: Nov. 14, 2006

(54) ARRANGEMENT FOR CONTROLLING THE EDGE OF PULP MASS IN A WEB FORMER AND A METHOD FOR CONTROLLING THE EDGE OF PULP MASS

(75) Inventors: Lassi Minkkinen, Karhula (FI); Harri Tähti, Karhula (FI)

(73) Assignee: Metso Paper, Inc., Helsinki (FI)

( * ) Notice: Subject to any disclaimer, the term of this patent is extended or adjusted under 35 U.S.C. 154(b) by 311 days.

(21) Appl. No.: 10/473,275

(22) PCT Filed: May 15, 2002

(86) PCT No.: PCT/FI02/00413

§ 371 (c)(1),
(2), (4) Date: Mar. 3, 2004

(87) PCT Pub. No.: WO02/095124

PCT Pub. Date: Nov. 28, 2002

(65) Prior Publication Data

US 2004/0154773 A1 Aug. 12, 2004

(30) Foreign Application Priority Data

May 23, 2001 (FI) ..... 20011078

(51) Int. Cl.
*D21F 1/80* (2006.01)
*D21F 1/56* (2006.01)
*B01D 33/056* (2006.01)

(52) U.S. Cl. ..... 162/310; 162/203; 162/208; 162/259; 162/301; 162/308; 162/353; 277/906

(58) Field of Classification Search ..... 162/203, 162/195, 208, 210, 211, 214, 215, 217, 252, 162/254, 256, 257, 262, 274, 297, 300, 301, 162/308, 310, 317, 331, 353; 210/400, 401, 210/450, 783, DIG. 3; 100/118, 37; 277/345, 277/387, 906, 926, 927

See application file for complete search history.

(56) References Cited

U.S. PATENT DOCUMENTS

| | | | | |
|---|---|---|---|---|
| 4,124,441 | A * | 11/1978 | Nykopp | 162/301 |
| 4,802,955 | A * | 2/1989 | Koski | 162/301 |
| 5,795,442 | A * | 8/1998 | Boyd et al. | 162/353 |
| 5,851,356 | A * | 12/1998 | Banning et al. | 162/203 |
| 6,136,153 | A * | 10/2000 | Rokman et al. | 162/336 |
| 6,368,463 | B1 * | 4/2002 | Juutinen | 162/301 |

FOREIGN PATENT DOCUMENTS

WO WO 00/43588 7/2000

OTHER PUBLICATIONS

Finnish Search Report for Finnish Priority Appl. No. 20011078 dated Jan. 14, 2002.
International Search Report for PCT/FI02/00413 dated Aug. 21, 2002.

* cited by examiner

*Primary Examiner*—Eric Hug
(74) *Attorney, Agent, or Firm*—Alston & Bird LLP

(57) ABSTRACT

The invention relates to an arrangement for controlling the edge of pulp mass in a web former, the web former comprising a space formed by two wires or the like, into which space the pulp mass is fed. The wires or the like are supported on a chamber units, which each time include at least one chamber for receiving the water removed from the pulp mass. In conjunction with the side edge of the said web former are arranged pulp mass edge control means, which include an edge sealing part. The edge sealing part extends, in the lateral direction of the web former, by a distance between the chamber units in such a way that it will prevent the pulp mass edge from passing and/or spreading in the lateral direction of the web former into the area of the said edge of the web former. The invention also relates to a method for controlling the pulp mass edge in a web former.

10 Claims, 4 Drawing Sheets

ARRANGEMENT FOR CONTROLLING THE EDGE OF PULP MASS IN A WEB FORMER AND A METHOD FOR CONTROLLING THE EDGE OF PULP MASS

BACKGROUND OF THE INVENTION

1) Field of the Invention

The present invention relates to an arrangement for controlling the edge of pulp mass in a web former, the web former comprising a space formed by two wires or the like, into which space the pulp mass is fed, the wires being supported on chamber units, which each time include at least one chamber for receiving the water removed from the pulp mass, and in conjunction with the side edge of the said web former there being arranged pulp mass edge control means, for preventing the pulp mass edge from passing and/or spreading in the lateral direction of the web former into the area of the side edge of the web former, said edge control means including means for feeding pressurised injection water into the area of the side edge of the web former.

The invention also relates to a method for controlling the edge of pulp mass, in which method the pulp mass is fed into a space formed by two wires, the wires or the like being supported on chamber units, which each time include at least one chamber for receiving the water removed from the pulp mass, and in conjunction with the side edge of the said web former there being arranged pulp mass edge control means, for preventing the pulp mass edge from passing and/or spreading in the lateral direction of the web former into the area of the side edge of the web former, in which method pressurised injection water is fed into the area of the side edge of the web former.

2) Description of Related Art

The Applicant's earlier Finnish patent application 19982539 discloses an apparatus for forming a pulp web, which resembles the present invention in basic principle. The apparatus comprises a headbox from which pulp mass is fed into a narrowing, wedge-like space formed by two wires, in which the dry matter content of the mass is increased by removing water from the mass in a controlled manner into a chamber for receiving it. At the end of the narrowing space are compaction means, by which the dry matter content of the mass is further increased. The invention according to the application 19982539 thus relates mainly to a method and apparatus for controlling the dry matter content of the mass during web forming. In this case, therefore, the lateral spreading of the mass towards the side edges of the wires and the water chambers and past them has hardly been considered at all. In practice, this spreading has been prevented with edge bars connected to the side edges, the purpose of which is mainly to prevent the mass from spreading outside the web former.

The aim of the present invention is to eliminate or substantially reduce the disadvantages of the prior art and further to provide an improved solution for controlling the edges of pulp mass in a web former.

BRIEF SUMMARY OF THE INVENTION

To achieve the aims of the present invention, the arrangement according to the invention is characterised in that the side edge control means of the web former include an edge sealing part which extends, in the lateral direction of the web former, by a distance between the chamber units, that in the edge sealing part are formed channels, through which the pressurised injection water can be fed between the chamber units and the surfaces of the edge sealing part.

The method relating to the invention is further characterised in that the passing and/or spreading of the pulp mass edge is prevented by means of an edge sealing part comprised in the side edge control means of the web former, which edge sealing part extends, in the lateral direction of the web former, by a distance between the chamber units, and by feeding pressurised injection water between the chamber units and the surfaces of the edge sealing part through channels formed in the edge sealing part. Preferred embodiments of the invention are disclosed in the dependent claims.

The present invention is described with examples in the following, with reference to the accompanying drawings, in which:

DETAILED DESCRIPTION OF THE INVENTION

Figure 1:
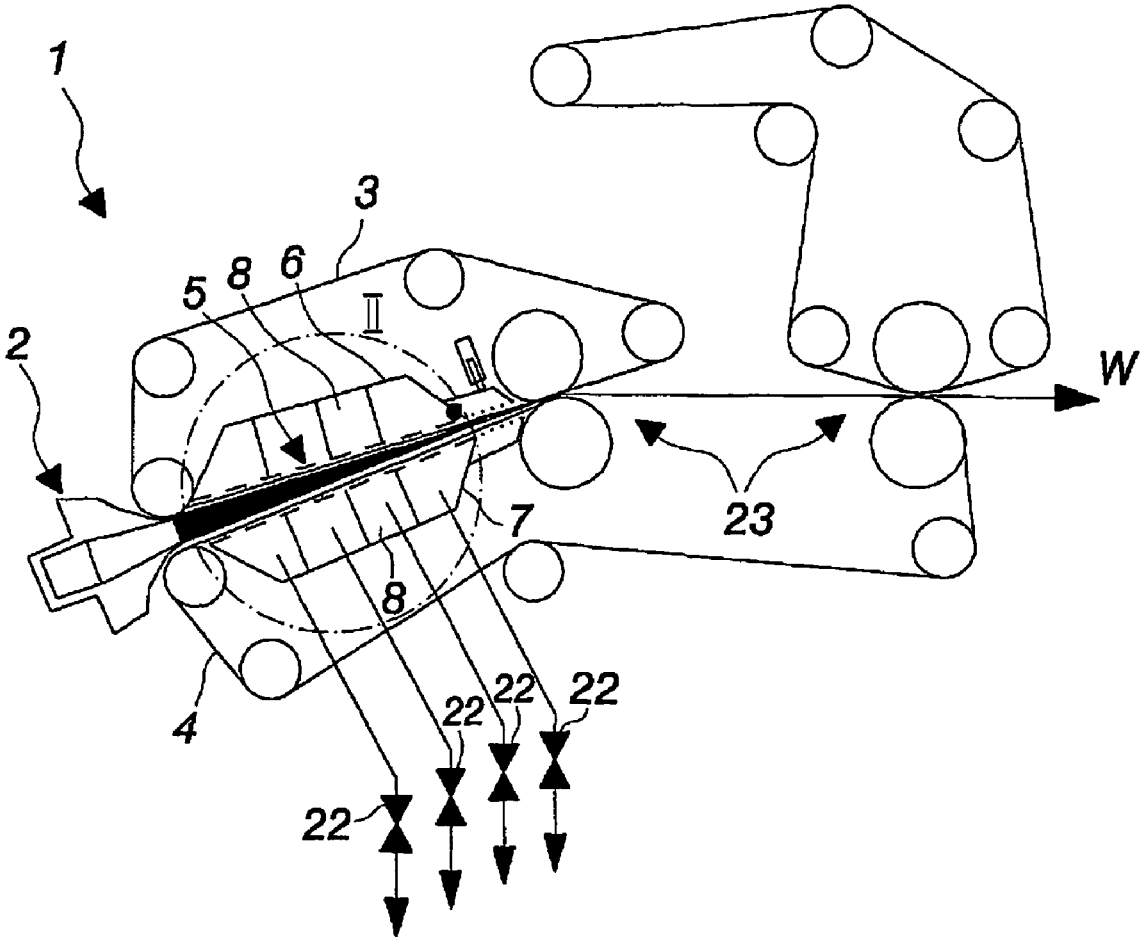
FIG. 1 shows a web former.

FIG. 1 shows a diagrammatic view of the web former 1 to which the arrangement according to the invention for controlling the edge of the pulp mass M is preferably applied. The operation and structure of the web former 1 are essentially previously known, for example, from the Applicant's earlier application 19982539 mentioned above, and thus they are described only briefly in the following.

The apparatus comprises a headbox 2, from which pulp mass M is fed into a narrowing, wedge-like space 5 connected to it. The space 5 is formed between two endless wire loops, such as a top wire 3 and a bottom wire 4 approaching each other in the direction of travel J. In connection with the surfaces on the opposite side to the mass flow of the wires 3 and 4 are supported chamber units 6 and 7 in a suitable wedge-like position, into the water removal chambers 8 of which, and further through water removal channels provided with valves 22, the water in the pulp can be removed in a controlled manner for further treatment.

Figure 3A:
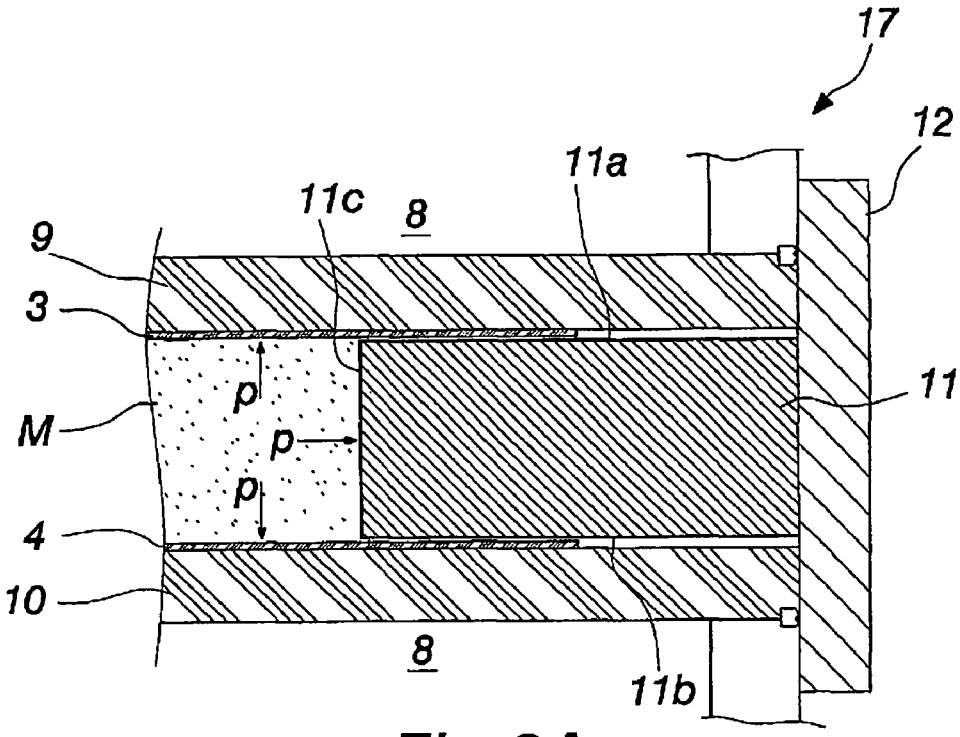
FIG. 3A shows a cross-section along line III—III in FIG. 2.

The mass M is fed at such speed and pressure between the wires 3 and 4 as they travel that an overpressure P prevails in the space 5. This overpressure P causes the water in the mass M to be filtered into the chambers 8 through the surfaces of the wires 3 and 4 and of the chambers 8 against the wires 3 and 4. Due to the same overpressure P, also the mass tends to spread in the lateral direction of the web former 1 towards the edge bars 12 or corresponding edges, and further outside the web former 1. The web W formed in the web former 1 is conveyed further for further treatment in an appropriate apparatus 23 further on. FIG. 3A shows an arrangement for controlling the spreading of the lateral mass mentioned above and the problems caused by the spreading in the area of the edge 17 of the web former 1.

Figure 2:
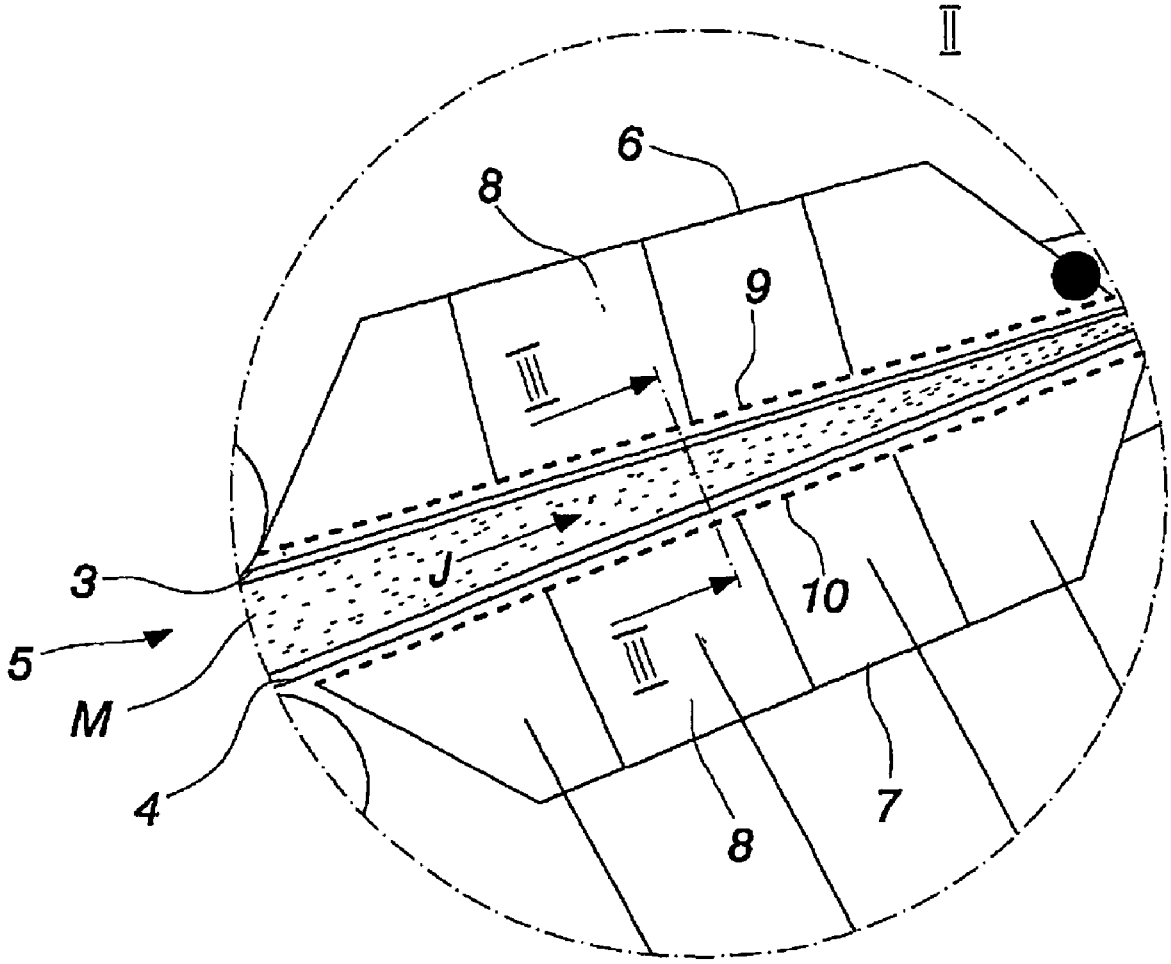
FIG. 2 shows a partial enlargement II of FIG. 1.

FIG. 3A shows a cross-section along line III—III in FIG. 2 of the arrangement on the right edge of the web former 1. A corresponding arrangement may obviously be applied to the left edge of the web former 1. In FIG. 3A is shown a cross-section of a top wire 3 and a bottom wire 4, between which the pulp mass M moves away from the viewer (direction of travel 3). To the surfaces of the wires 3 and 4 on the opposite side to the mass flow are connected the water removal chambers 8 of the chamber units 6 and 7. To wire 3 is connected surface 9 of chamber unit 6, and to wire 4 is correspondingly connected surface 10 of chamber unit 7. Surfaces 9 and 10 are such that the water in the overpressured mass M permeates through them and passes on to the chambers 8, thus acting as filtrate surfaces.

In conjunction with the side edges of the filtrate surfaces 9 and 10 located at a distance from each other is arranged an essentially continuous and elongated side cover 12 or the like. The edge bar 12 covers the opening remaining between the side edges of the surfaces 9 and 10 in such a way that it essentially prevents the pulp mass M from spreading outside the side edges of the surfaces 9 and 10. In addition to this, in connection with the side cover 12 is arranged an edge sealing part 11. Here its cross-section is such that it extends, in the lateral direction of the wires 3 and 4, essentially transversely to the direction of travel of the mass M, by a distance into the space 5 between the wires 3 and 4 and both the chambers and the permeable surfaces 9 and 10. The edge sealing part 11 may extend further between the wires 3 and 4 in a transverse direction with respect to the direction of travel of the mass M. Correspondingly, the edge sealing part 11 may extend by a short distance only between the chambers 6 and 7, in a transverse direction with respect to the direction of travel of the mass M. In the edge sealing part 11 are formed elongated opposite sealing faces 11*a* and 11*b* in the direction of travel of the mass M. They are in contact with the surfaces of the wires 3 and 4 approaching each other in a wedge-like manner, or in their immediate vicinity. Thus also the sealing faces 11*a* and 11*b* together form a wedge-like shape complying with the space 5 in the longitudinal direction. The edge sealing part 11 is of such material that it withstands especially the mass M, but also the mechanical wear caused by the wires 3 and 4 and heat stress. The material is in addition preferably such against which the mass M, as well as the wires 3 and 4, slide as frictionlessly as possible. Such a material is, for example, hard plastic, fibre-reinforced plastic or a metal alloy.

The surface 11*c* of the other end of the edge sealing part 11 extending between the wires 3 and 4 is essentially smooth and formed in the transverse direction with respect to the plane formed by the sliding surfaces 11*a* and 11*b*. The surface 11*c* of the other end is such that the mass M compressing in the space 5 will slide against it with sufficiently low friction, so that no disadvantageous changes will take place in the mass M. Furthermore, the surface 11*c* receives the pressure of the mass M compressing in the space and prevents the access of the mass M outside the edges of the web former 1, and more preferably outside the edges of the wires 3 and 4. The sliding surfaces 11*a* and 11*b* in addition press the wires 3 and 4 against the filtrate surfaces 9 and 10, which for its part prevents the curling up of the wires 3 and 4.

The chamber units 6 and 7 of the web former 1 move with respect to each other, that is, their wedge-like shape and distance from each other can be adjusted. For this purpose, for the same web former 1 may be made different edge sealing parts 11 suitable for certain adjustments, the wedge-like shape between the sliding surfaces 11*a* and 11*b* of which in the longitudinal direction of the web former 1, and extension in the lateral direction of the web former 1, are suitable for the various adjustments of the web former 1. Other appropriate structural changes may also be made in the edge sealing part 11.

Figure 3B:
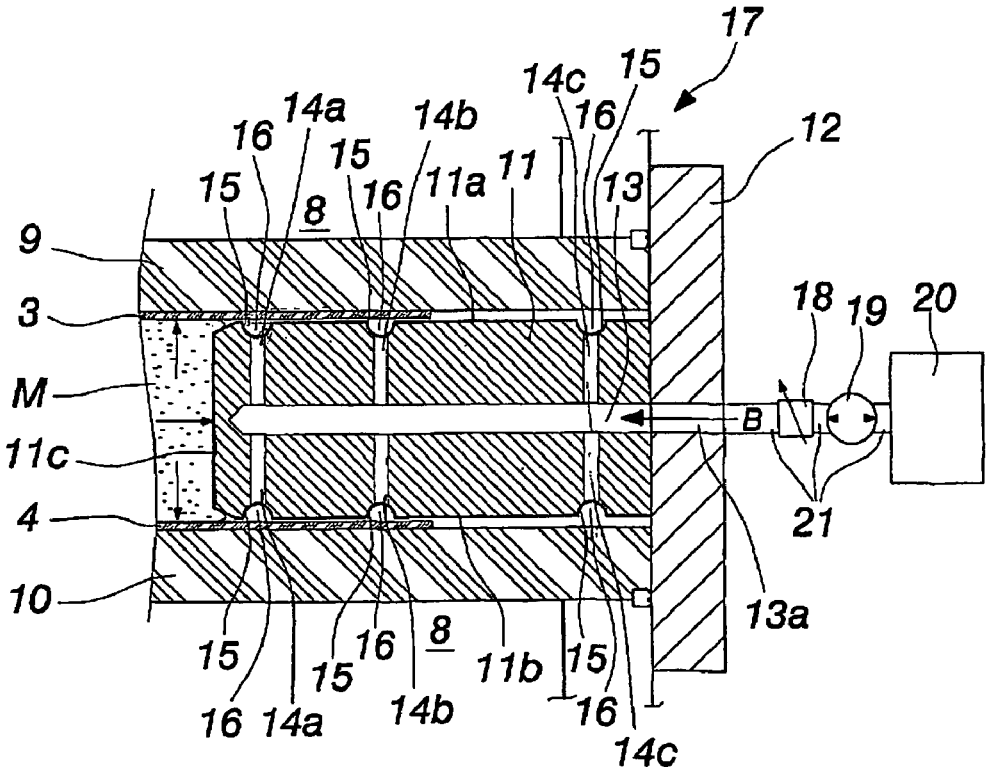
FIG. 3B shows a cross-section along line III—III in FIG. 2, according to an alternative example.
Figure 4:
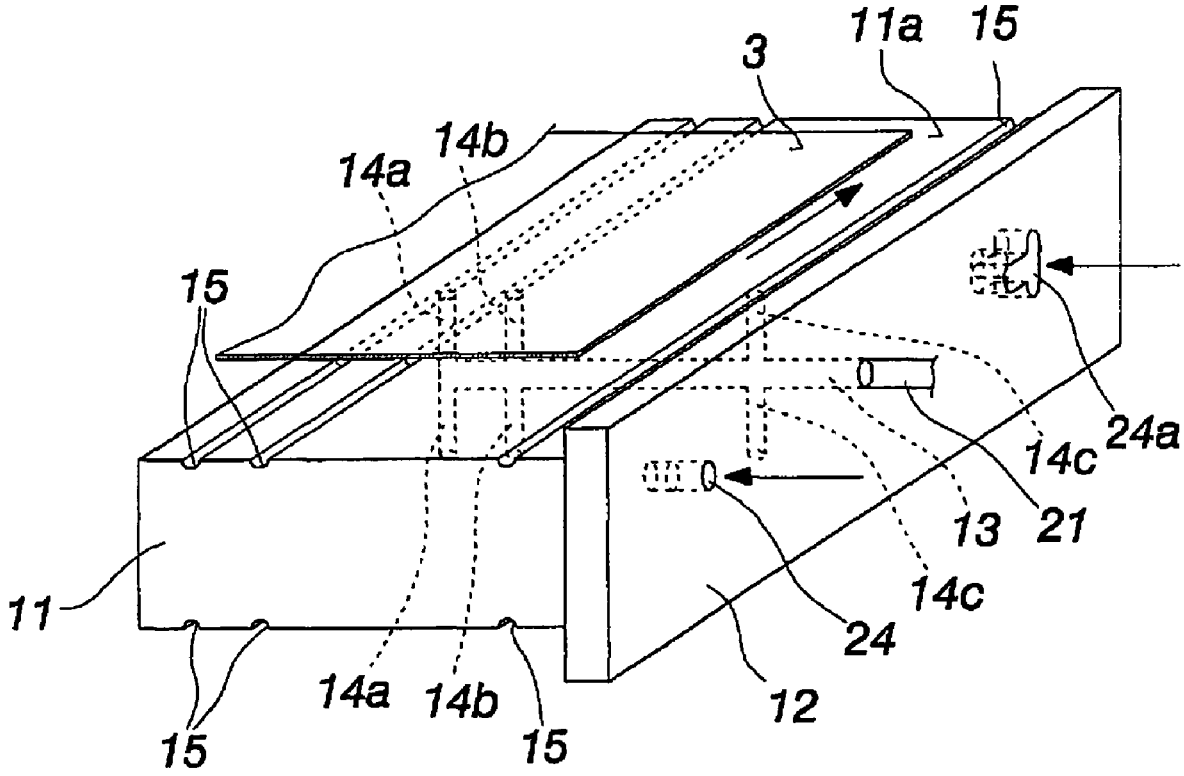
FIG. 4 shows an axonometric view of an edge sealing part according to FIG. 3B.

FIGS. 3B and 4 show a preferred embodiment of the invention. In FIG. 3B, the same or corresponding parts are marked with the same reference numerals as in FIG. 3A, and therefore, their description is omitted.

In the edge sealing part 11 are formed channels 13, 14*a*, 14*b*, 14*c*, 15, for example, by drilling. The main channel 13 is here formed preferably inside the edge sealing part 11, in the centre in both the longitudinal direction and in elevation so that the inlet opening will open to the surface connected to the side cover 12, and that it will extend in its longitudinal direction by a distance between the chamber units 6 and 7. In this case, one main channel 13 also extends by a distance between the wires 3 and 4. There may be several main channels, which are arranged at regular distances from each other. In connection with the main channel 13 are formed two successive channel branches 14*a* and 14*b*, essentially in a transverse direction with respect to the main channel 13. A single channel branch 14*a* or 14*b* has two branches, the first of which opens into a groove 15 formed on the sliding surface 11*a* of the edge sealing part 11, in the immediate vicinity of the top wire 3, and the second branch opens into a groove 15 formed on the sliding surface 11*b* of the edge sealing part 11, in the immediate vicinity of the bottom wire 4. In connection with the main branch 13 is also formed a third separate channel branch 14*c*. Its first branch opens into a groove 15 formed on the sliding surface 11*a* of the edge sealing part 11, in the immediate vicinity of filtrate surface 9 of chamber unit 6, and the second branch opens into a groove 15 formed on the sliding surface 11*b* of the edge sealing part 11, in the immediate vicinity of filtrate surface 10 of chamber unit 7.

Each channel branch thus opens into a groove 15 formed on the opposite sliding surfaces 11*a*, 11*b*. In shape, the grooves 15 are continuous chute-like grooves formed in the longitudinal direction of the edge sealing part 11, the grooves forming sealing channels 16, while the filtrate surfaces 9 and 10 or wires 3 and 4 are in contact with the sliding surfaces 11*a* and 11*b*.

Injection water B is fed into the sealing channels 16 via the main channel 13 and the channel branches 14*a*, 14*b* and 14*c*. Through the sealing channels 16, the injection water B can be fed further between the sliding surfaces 11*a*, 11*b* and the wires 3, 4 (or filtrate surfaces 9, 10), in which case the injection water acts as a lubricant between the edges of the wires 3 and 4 (or filtrate surfaces 9 and 10) and the sliding surfaces 11*a* and 11*b* of the edge sealing part 11. In this case, the sliding surfaces 11*a*, 11*b* and the wires 3, 4 (or filtrate surfaces 9, 10) are not in contact with each other. The injection water B is preferably fed into the main channel 13 from a separate container 20 via a feed pipe 21 which is connected to a channel 13*a* formed in the side cover 12, the channel 13*a* in turn being connected to the main channel 13. The injection water B is pressurised by means of a pump 19 connected to the pipe 21, and pressure and amount are adjusted by means of a control valve 18 connected to the pipe 21.

In the sealing channels 16 and between the sliding surfaces 11*a*, 11*b* and the wires (or filtrate surfaces 9, 10) prevails a hydrostatic pressure due to the feeding of the pressurised injection water B. This pressure acts as a counterpressure to the pressure prevailing in the pulp mass M. In other words, the counterpressure of the injection water prevents the mass M under overpressure from spreading between the wires 3 and 4 (or filtrate surfaces 9 and 10) and the sliding surfaces 11*a* and 11*b* of the edge sealing part 11 to the area of the side edge 17 of the web former 1. At the same time, the pressurised injection water B between the sliding surfaces 11*a*, 11*b* and the wires 3, 4 presses the wires 3 and 4 against the filtrate surfaces 9 and 10, thus preventing for its part the curling up of the wires 3 and 4.

When in contact with the pulp mass M, the edge sealing part 11 is subjected to temperature variations, contrary to, for example, the side cover 12 remaining outside the web former, to which cover the edge sealing part 11 is attached. This causes a different type of heat expansion of the edge sealing part 11 and of the side cover 12. To compensate for the different types of heat expansion, the attachment between the edge sealing part 11 and the side cover 12 is a sliding one. The sliding attachment is illustrated in FIG. 4. Attachment is arranged at two points 24, 24*a*. At the forward end of the side cover 12 is a fixed, for example, screw attachment 24 and at the tail end of the side cover 12 is another screw attachment 24*a* which allows the edge sealing part 11 and the side cover 12 to move with respect to each other. This is made possible by longitudinal and vertical slots made in the screw hole 24*a* of the side cover 12. The sliding attachment may obviously also be arranged in a different manner, and the attachment of the edge sealing part 11 does not necessarily have to be formed on the side cover 12, but generally on an appropriate structural part of the web former 1.

The invention claimed is:

1. An arrangement for controlling the edge of a pulp mass in a web former, the web former defining a wedge-shaped space extending in a machine direction between two opposing and converging wires for receiving the pulp mass, and having opposing side edges, the wires being supported to define the wedge-shaped space by respective chamber units, with each chamber unit including at least one chamber for receiving the water removed from the pulp mass, said arrangement comprising:

an edge control device having at least one edge control element disposed between opposing chamber units about at least one side edge of the web former, and laterally extending at least partially between the opposing wires, the at least one edge control element further defining at least one channel extending therethrough, with the at least one channel being configured to direct a pressurized injection fluid outwardly therefrom, toward at least one of the opposing wires and the opposing chamber units, such that the pressurized injection fluid forms a seal between the at least one edge control element and the at least one of the opposing wires and the opposing chamber units, thereby substantially preventing the pulp mass from spreading laterally outward past the side edges of the web former.

2. An arrangement according to claim 1, wherein the at least one edge control element is further configured such that the pressurized injection fluid directed outwardly therefrom via the at least one channel forms a seal between the at least one edge control element and the at least one of the opposing wires and the opposing chamber units and substantially prevents the pulp mass from spreading laterally outward past opposed lateral edges of the wires.

3. An arrangement according to claim 1, wherein the at least one edge control element includes substantially opposed surfaces configured to correspond to the wedge-shaped space in the machine direction, with the at least one edge control element being further disposed such that the opposed surfaces at least partially contact the wires.

4. An arrangement according to claim 3, wherein the at least one edge control element further defines a plurality of channels extending through the opposed surfaces, the plurality of channels being spaced laterally with respect to the machine direction such that the pressurized injection fluid directed outwardly therefrom forms a seal between the opposed surfaces of the at least one edge control element and the at least one of the opposing wires and the opposing chamber units.

5. An arrangement according to claim 1, wherein the at least one channel is further configured to extend in the machine direction along the at least one edge control element such that the seal provided by the pressurized injection fluid is substantially continuous in the machine direction along the at least one edge control element.

6. An arrangement according to claim 1, wherein the injection fluid comprises water, and at least one of a feed pressure of the injection water and an amount of the injection water is adjustable.

7. An arrangement according to claim 1, wherein the at least one edge control element is comprised of a heat resistant and wear resistant material, and is selected from the group consisting of a hard plastic material, a fiber-reinforced plastic material, a metal alloy, and combinations thereof.

8. An arrangement according to claim 1, wherein the at least one edge control element is operably engaged with the web former through an attachment mechanism configured to cooperate with the at least one edge control element such that the at least one edge control element is movable in the machine direction.

9. A method for controlling the edge of a pulp mass in a web former defining a wedge-shaped space extending in a machine direction between two opposing and converging wires for receiving the pulp mass, the web former further having opposing side edges, and the wires being supported to define the wedge-shaped space by respective chamber units, each chamber unit including at least one chamber for receiving the water removed from the pulp mass, said method comprising:

directing a pressurized injection fluid through at least one channel defined by and extending through at least one edge control element of an edge control device, the at least one edge control element being disposed between opposing chamber units about at least one side edge of the web former, and laterally extending at least partially between the opposing wires, the at least one channel being configured to direct the pressurized injection fluid outwardly therefrom, toward at least one of the opposing wires and the opposing chamber units, such that the pressurized injection fluid forms a seal between the at least one edge control element and the at least one of the opposing wires and the opposing chamber units, thereby substantially preventing the pulp mass from spreading laterally outward past the side edges of the web former.

10. A method according to claim 9, wherein directing a pressurized injection fluid through at least one channel further comprises directing a pressurized injection fluid through a plurality of channels extending through substantially opposed surfaces of the at least one edge control element, the opposed surfaces being configured to correspond to the wedge-shaped space in the machine direction, and the plurality of channels being spaced laterally with respect to the machine direction such that the pressurized injection fluid directed outwardly therefrom forms a seal between the opposed surfaces of the at least one edge control element and the at least one of the opposing wires and the opposing chamber units.

* * * * *